US006433657B1

(12) United States Patent
Chen

(10) Patent No.: US 6,433,657 B1
(45) Date of Patent: Aug. 13, 2002

(54) MICROMACHINE MEMS SWITCH

(75) Inventor: Shuguang Chen, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/830,893

(22) PCT Filed: Nov. 2, 1999

(86) PCT No.: PCT/JP99/06113

§ 371 (c)(1),
(2), (4) Date: May 2, 2001

(87) PCT Pub. No.: WO00/26933

PCT Pub. Date: May 11, 2000

(30) Foreign Application Priority Data

Nov. 4, 1998 (JP) ..... 10-313017

(51) Int. Cl.[7] ..... H01P 1/10
(52) U.S. Cl. ..... 333/262; 333/105; 200/181
(58) Field of Search ..... 333/262, 105, 333/197; 200/181; 335/185; 361/207

(56) References Cited

U.S. PATENT DOCUMENTS 5,121,089 A * 6/1992 Larson ..... 200/181
5,619,061 A 4/1997 Goldsmith et al. ..... 257/528
6,072,686 A * 6/2000 Yarbrough ..... 200/181
6,094,116 A * 7/2000 Tai et al. ..... 200/181

FOREIGN PATENT DOCUMENTS

| | | |
|---|---|---|
| JP | 2-100224 | 4/1990 |
| JP | 3-53731 | 5/1991 |
| JP | 4-133226 | 5/1992 |
| JP | 4-370622 | 12/1992 |
| JP | 5-2976 | 1/1993 |

* cited by examiner

*Primary Examiner*—Robert Pascal
*Assistant Examiner*—Dean Takaoka
(74) *Attorney, Agent, or Firm*—Sughrue Mion, PLLC

(57) ABSTRACT

A switch includes at least two distributed constant lines (2*a*, 2*b*) disposed close to each other, a movable element (11) arranged above the distributed constant lines so as to oppose these distributed constant lines and connecting the distributed constant lines to each other in a high-frequency manner upon contacting the distributed constant lines, and a driving means (13) for displacing the movable element by an electrostatic force to bring the movable element into contact with the distributed constant lines. The movable element has a projection (52*a*, 52*b*) formed by notching at least one end of an edge of the movable element which is located on at least one distributed constant line side. In this projection, a width (a) serving as a length in a direction parallel to the widthwise direction of the distributed constant lines is smaller than a width (W) of each of the distributed constant lines.

20 Claims, 6 Drawing Sheets

MICROMACHINE MEMS SWITCH

TECHNICAL FIELD

The present invention relates to a micromachine switch used in a milliwave band to microwave band.

BACKGROUND ART

Switch devices such as a PIN diode switch, HEMT switch, micromachine switch, and the like are used in a milliwave band to microwave band. Of these switches, the micromachine switch is characterized in that the loss is smaller than that of the other devices, and a compact high-integrated switch can be easily realized.

FIG. 13 is a perspective view showing the structure of a conventional micromachine switch. FIG. 14 is a plan view of the micromachine switch shown in FIG. 13.

A micromachine switch 101 is constructed by a switch movable element 111, support means 112, and switch electrode 113. The micromachine switch 101 is formed on a dielectric substrate 103 together with two RF microstrip lines 102*a* and 102*b*. A GND plate 104 is disposed on the lower surface of the dielectric substrate 103.

The microstrip lines 102*a* and 102*b* are closely disposed apart from each other at a gap G. The switch electrode 113 is disposed between the microstrip lines 102*a* and 102*b* on the dielectric substrate 103. The switch electrode 113 is formed to have a height lower than that of each of the microstrip lines 102*a* and 102*b*.

The switch movable element 111 is arranged above the switch electrode 113. A capacitor structure is formed by the switch electrode 113 and switch movable element 111.

As shown in FIG. 14, since a length L of the switch movable element 111 is larger than the gap G, two ends of the switch movable element 111 oppose the end portions of the microstrip lines 102*a* and 102*b*, respectively. The switch movable element 111 is formed to have a width equal to the width W of each of the microstrip lines 102*a* and 102*b*.

The switch movable element 111 is cantilevered on the support means 112 fixed on the dielectric substrate 103.

As shown in FIG. 13, the switch movable element 111 is generally arranged above the microstrip lines 102*a* and 102*b*. With this structure, since the switch movable element 111 is not in contact with the microstrip lines 102*a* and 102*b*, the micromachine switch 101 is in an OFF state. At this time, a little high-frequency energy is transmitted from the microstrip line 102*a* to the microstrip line 102*b*.

When, however, a control voltage is applied to he switch electrode 113, the switch movable element 111 is pulled down by an electrostatic force. When the switch movable element 111 is brought into contact with the microstrip lines 102*a* and 102*b*, the switch movable element 111 is set in an ON state. At this time, the high-frequency energy from the microstrip line 102*a* is transmitted to the microstrip line 102*b* through the switch movable element 111.

As described above, the two ends of the switch movable element 111 oppose the microstrip lines 102*a* and 102*b*, respectively. Accordingly, the capacitor structures are also formed between the switch movable element 111 and the microstrip lines 102*a* and 102*b*.

This makes the capacitive coupling between the switch movable element 111 and microstrip lines 102*a* and 102*b* so that the high-frequency energy from the microstrip line 102*a* leaks out into the microstrip line 102*b* even if the micromachine switch 101 is in the OFF state. That is, in the conventional micromachine switch 101, an OFF isolation characteristic is poor.

In the microwave switching circuit, for example, the isolation of approximately 15 dB or more is required.

The present invention has been made to solve the above problem, and has as its object to improve the OFF isolation characteristic of the micromachine switch.

DISCLOSURE OF INVENTION

In order to achieve the above object, the present invention comprises at least two distributed constant lines disposed close to each other, a movable element arranged above the distributed constant lines so as to oppose the distributed constant lines and connecting the distributed constant lines to each other in a high-frequency manner upon contacting the distributed constant lines, and driving means for displacing the movable element by an electrostatic force to bring the movable element into contact with the distributed constant lines, wherein the movable element includes a projection formed by notching at least one end of an edge of the movable element which is located on at least one distributed constant line side, and a width of the projection serving as a length in a direction parallel to the widthwise direction of the distributed constant lines is smaller than a width of each of the distributed constant lines. That is, at least one end of the movable element is notched to form the projection having the width (the length in the direction parallel to the widthwise direction of the distributed constant lines) smaller than that of the distributed constant line, and the projection is made to oppose the distributed constant line. This decreases the opposing area between the movable element and the distributed constant line, thereby reducing the capacitive coupling of them. Therefore, the OFF isolation characteristic of the micromachine switch can be improved. In addition, since the width of the movable element on the gap between the distributed constant lines becomes larger as compared to the case in which a movable element having the rectangular shape and the width smaller than that of the distributed constant line is used, the present invention can obtain ON reflection characteristic better than that in the above case.

In the present invention, at least one distributed constant line opposing the projection of the movable element does not oppose a movable element main body serving as a portion of the movable element expect for the projection. That is, only the projection of the movable element opposes the distributed constant line. Accordingly, the width of the movable element opposing the distributed constant line is smaller than that of the distributed constant line as a whole. Thus, an OFF isolation characteristic similar to that in the case in which the movable element having the rectangular shape and the width smaller than that of the distributed constant line is used can be realized, and an ON reflection characteristic better than that in that case can be obtained.

In the present invention, at least one distributed constant line opposing the projection of the movable element also opposes a part of a movable element main body serving as a portion of said movable element expect for the projection. That is, the projection of the movable element and the part of the movable element main body oppose the distributed constant line. Thus, the opposing area between the movable element and the distributed constant line is increased as compared to the above invention, and, an OFF isolation characteristic can be improved as compared to the prior art.

In this case, the movable element main body of the movable element is formed to have a width equal to the width of the distributed constant line. Thus, there is almost no discontinuous portion between the distributed constant line and movable element, and an ON reflection characteristic better than that in the above invention can be obtained.

In the present invention, the projection of the movable element has a rectangular shape. When the rectangular projection is formed by notching two ends of the movable element, the opposing area between the movable element and the distributed constant line is a predetermined area even if the positioning error occurs in the longitudinal direction of the movable element.

In the present invention, the width of the projection of the movable element near the movable element main body serving as a portion of the movable element expect for the projection is made larger than that away from the movable element main body.

Since the width of the projection of the movable element near the movable element main body serving as a portion of the movable element expect for the projection is made larger than that away from the movable element main body, the strength of the projection increases.

Also, the present invention comprises at least two distributed constant lines disposed close to each other, a movable element arranged above the distributed constant lines so as to oppose the distributed constant lines and connecting the distributed constant lines to each other in a high-frequency manner upon contacting the distributed constant lines, and driving means for displacing the movable element by an electrostatic force to bring the movable element into contact with the distributed constant lines, wherein at least one distributed constant line includes a projection formed by notching at least one end of an edge of at least one distributed constant line on the movable element side, and a width of the projection is smaller than a length, serving as a width of the movable element, in a direction parallel to the widthwise direction of the distributed constant lines. That is, at least one end of the distributed constant line is notched to form the projection having the width (the length in the direction parallel to the widthwise direction of the distributed constant lines) smaller than that of the movable element, and the projection is made to oppose the movable element. This decreases the opposing area between the movable element and the distributed constant line, thereby reducing the capacitive coupling of them. Therefore, the OFF isolation characteristic of the micromachine switch can be improved. In addition, a good ON reflection characteristic can be obtained as compared to the case in which a movable element having the rectangular shape and the width smaller than that of the distributed constant line is used.

In the present invention, the movable element does not oppose a distributed constant line main body serving as a portion, expect for the projection, of at least one distributed constant line having the projection. That is, only the projection of the distributed constant line opposes the movable element. Accordingly, an OFF isolation characteristic similar to that in the case in which the movable element having the rectangular shape and the width smaller than that of the distributed constant line is used can be realized, and an ON reflection characteristic better than that in that case can be obtained.

In the present invention, the movable element also opposes a part of a distributed constant line main body serving as a portion, expect for the projection, of at least one distributed constant line having the projection. That is, the projection of the distributed constant line and the part of the distributed constant line main body oppose the movable element. Thus, an OFF isolation characteristic can be improved as compared to the above invention.

In this case, the movable element may be formed to have a width equal to the width of each of the distributed constant line main bodies. Thus, an ON reflection characteristic better than that in the above invention can be obtained.

In the present invention, the projection of at least one distributed constant line has a rectangular shape. Thus, even if the positioning error occurs in the longitudinal direction of the movable element, the opposing area between the movable element and the distributed constant line is a predetermined area.

In addition, the present invention comprises at least two distributed constant lines disposed close to each other, a movable element arranged above the distributed constant lines so as to oppose the distributed constant lines and connecting the distributed constant lines to each other in a high-frequency manner upon contacting the distributed constant lines, and driving means for displacing the movable element by an electrostatic force to bring the movable element into contact with the distributed constant lines, wherein at least one distributed constant line includes a first projection formed by notching at least one end of an edge of at least one distributed constant line on the movable element side, and the movable element includes a second projection so formed as to oppose the first projection of at least one distributed constant line by notching at least one end of an edge of the movable element. With this structure, an OFF isolation characteristic of the micromachine switch can be improved. In addition, a good ON reflection characteristic can be obtained as compared to the case in which a movable element having the rectangular shape and the width smaller than that of the distributed constant line is used.

In the present invention, at least an entire lower surface of the movable element is made of a conductor.

In the present invention, the movable element is made of a conductive member and an insulating thin film formed on an entire lower surface of the conductive member.

In the present invention, the driving means comprises an electrode which is disposed apart between the distributed constant lines so as to oppose the movable element and to which a driving voltage is selectively applied.

In the present invention, the invention further comprises support means for supporting the movable element, the driving means is made of an upper electrode attached to the support means and a lower electrode disposed under the upper electrode and opposing the upper electrode, and a driving voltage is selectively applied to at least one of the upper and lower electrodes.

BEST MODE OF CARRYING OUT THE INVENTION

A micromachine switch according to embodiments of the present invention will be described in detail below with reference to the accompanying drawings. A micromachine switch to be described here is a microswitch suitable for integration by a semiconductor element manufacturing process.

In a microstrip line (distributed constant line), the length of the microstrip line in a longitudinal direction is defined as a "length", and the length of the microstrip line in a widthwise direction perpendicular to the longitudinal direction is defined as a "width". In a movable element, the length in a direction parallel to the longitudinal direction of the microstrip line is defined as "length", and the length in a direction parallel to the widthwise direction of the microstrip line is defined as a "width".

First Embodiment

Figure 1:
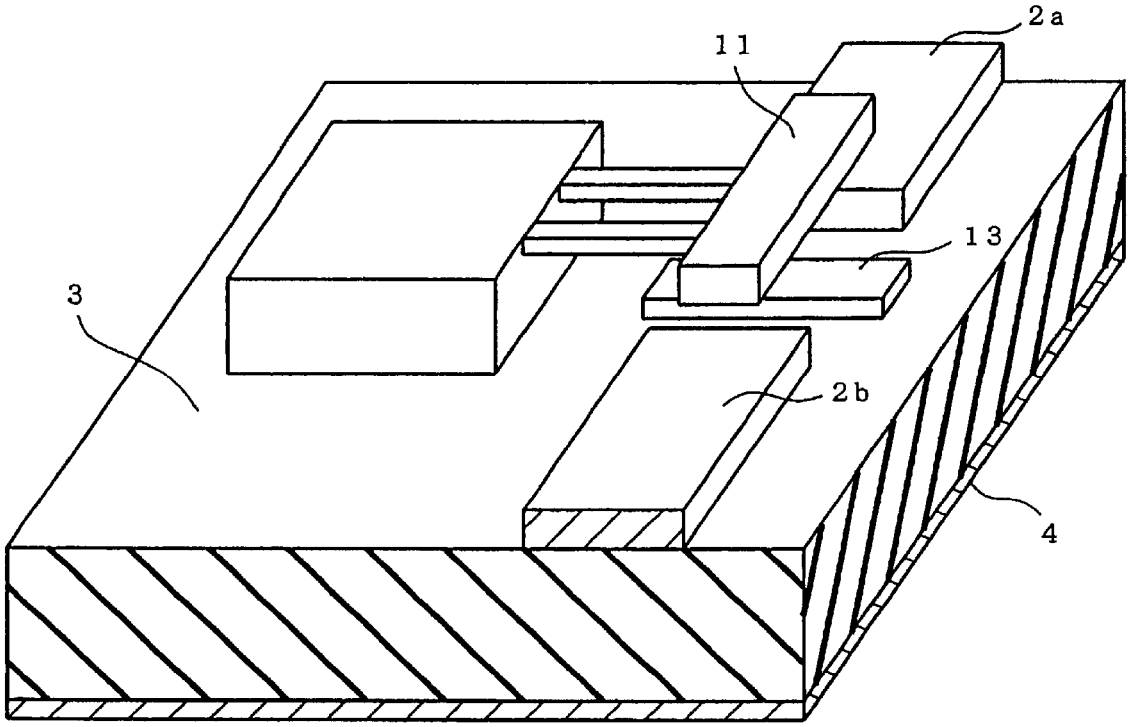
FIG. 1 is a perspective view showing the structure of a micromachine switch according to the first embodiment of the present invention.
Figure 2:
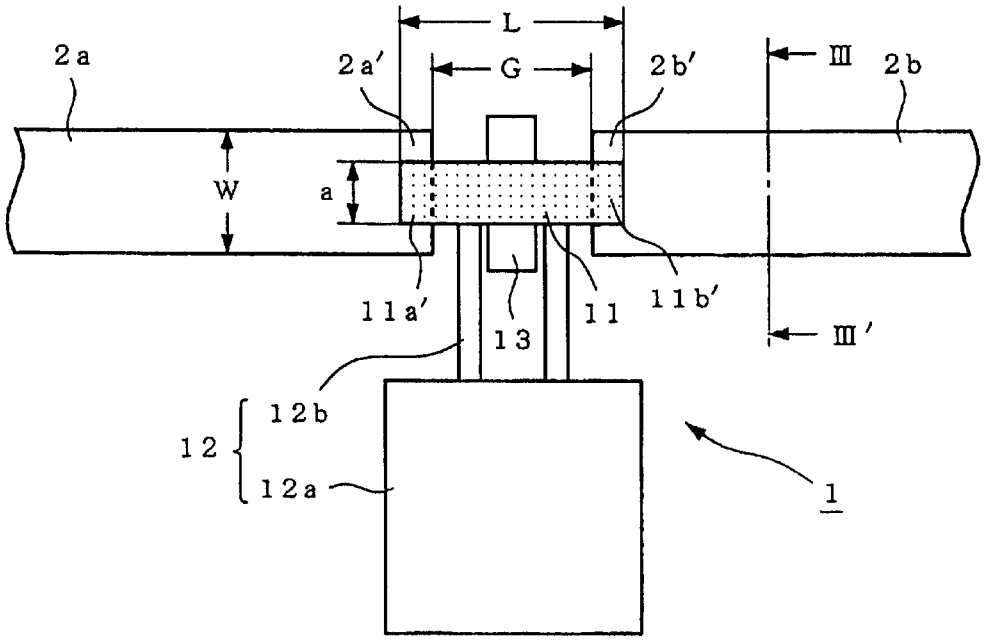
FIG. 2 is a plan view of the micromachine switch shown in FIG. 1.

FIG. 1 is a perspective view showing the structure of a micromachine switch according to the first embodiment of the present invention. FIG. 2 is a plan view of the micromachine switch shown in FIG. 1.

As shown in FIG. 1, a micromachine switch 1 is constructed by a switch movable element 11, support means 12, and switch electrode (driving means) 13. The micromachine switch 1 is formed on a dielectric substrate 3 together with two RF microstrip lines (distributed constant lines) 2*a* and 2*b*. A GND plate 4 is disposed on the lower surface of the dielectric substrate 3.

The microstrip lines 2*a* and 2*b* are closely disposed apart from each other at a gap G. The width of each of both microstrip lines 2*a* and 2*b* is W.

The switch electrode 13 is disposed apart between the microstrip lines 2*a* and 2*b* on the dielectric substrate 3. The switch electrode 13 is formed to have a height lower than that of each of the microstrip lines 2*a* and 2*b*. A driving voltage is selectively applied to the switch electrode 13 on the basis of an electrical signal.

The switch movable element 11 is arranged above the switch electrode 13. The switch movable element 11 is made of a conductive member. A capacitor structure is therefore formed by the switch electrode 13 and switch movable element 11 opposing each other.

On the other hand, the support means 12 for supporting the switch movable element 11 is constructed by a post portion 12*a* and arm portion 12*b*. The post portion 12*a* is fixed on the dielectric substrate 3 apart from the gap G between the microstrip lines 2*a* and 2*b* by a predetermined distance. The arm portion 12*b* extends from one end of the upper surface of the post portion 12*a* to the gap G. The support means 12 is made of a dielectric, semiconductor, or conductor.

The switch movable element 11 is fixed on a distal end of the arm portion 12*b* of the support means 12.

As shown in FIG. 2, the switch movable element 11 has a rectangular shape as a whole, and a length L of the switch movable element 11 is larger than the gap G. With this structure, distal end portions 11*a*' and 11*b*' of the switch movable element 11 oppose parts of distal end portions 2*a*' and 2*b*' of the microstrip lines 2*a* and 2*b*, respectively.

The distal end portions 11*a*' and 11*b*' of the switch movable element 11 are defined as portions each extending by a length (L−G)/2 from a corresponding one of the two ends of the switch movable element 11. The distal end portions 2*a*' and 2*b*' of the microstrip lines 2*a* and 2*b* are defined as portions each extending by a length (L−G)/2 from a corresponding one of opposing ends of the microstrip lines 2*a* and 2*b*.

Distal end portions 14*a*' and 14*b*', 15*a*' and 15*b*', and 16*a*' and 16*b* of switch movable elements 14, 15, and 16, and microstrip lines 6*a* and 6*b* and 7*a* and 7*b* of the distal end portions 6*a*' and 6*b*' and 7*a*' and 7*b*' (to be described later) have the same arrangement as described above.

A width a of the switch movable element 11 is smaller than the width W of each of the microstrip lines 2*a* and 2*b*. The area of each of the distal end portions 11*a*' and 11*b*' of the switch movable element 11 is therefore smaller than that of each of the distal end portions 2*a*' and 2*b*' of the microstrip lines 2*a* and 2*b*.

Figure 3A:
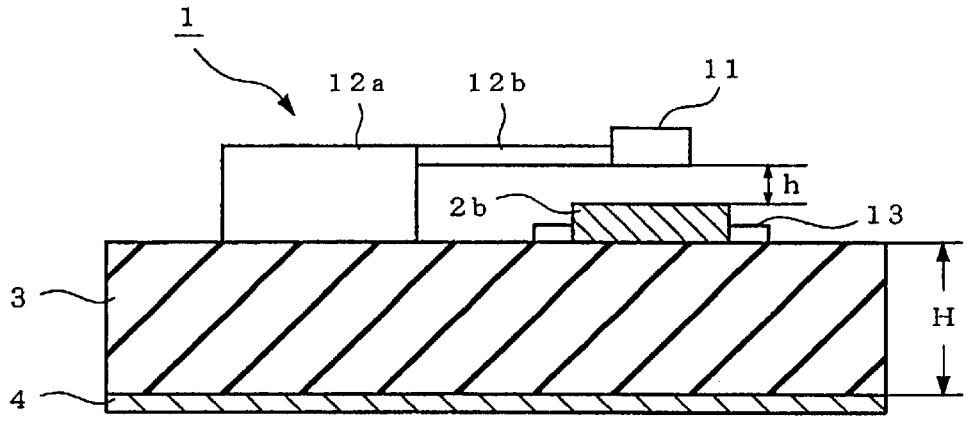
FIGS. 3A and 3B are sectional views taken along the line III–III' of the micromachine switch shown in FIG. 2.
Figure 3B:
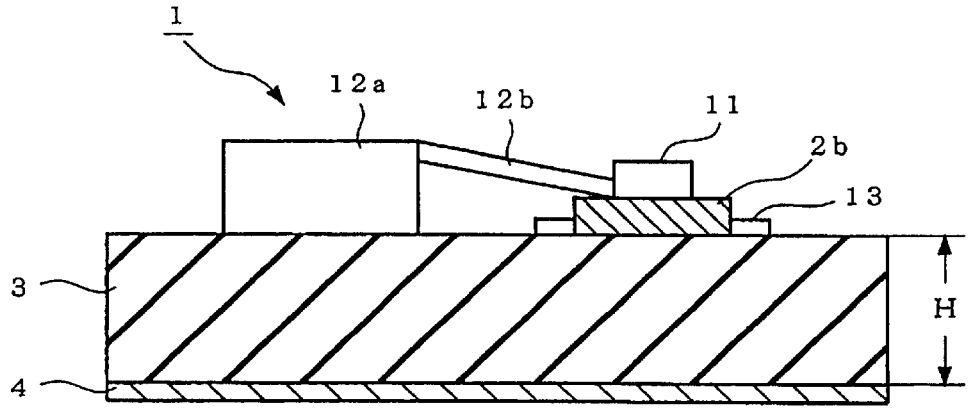

An operation of the micromachine switch 1 shown in FIG. 1 will be described next. FIGS. 3*a* and 3*b* are sectional view taken along the line III–III' of the micromachine switch 1 shown in FIG. 2, in which FIG. 3(*a*) shows the OFF state of the micromachine switch 1, and FIG. 3(*b*) shows the ON state.

As shown in FIG. 3(*a*), the switch movable element 11 is generally positioned at a portion apart from the microstrip lines 2*a* and 2*b* by a height h. In this case, the height h is approximately several $\mu$m.

If, therefore, no driving voltage is applied to the switch electrode 13, the switch movable element 11 is not in contact with the microstrip lines 2*a* and 2*b*.

However, the switch movable element 11 has the portions opposing the microstrip lines 2*a* and 2*b*. Since the capacitor structure is. formed at these portions, the microstrip lines 2*a* and 2*b* are coupled to each other through the switch movable element 11.

A capacitance between the switch movable element 11 and the microstrip lines 2*a* and 2*b* is proportional to the opposing area between the switch movable element 11 and microstrip lines 2*a* and 2*b*. In the conventional micromachine switch 101 shown in FIG. 13, the width of the switch movable element 111 is equal to the width W of each of the microstrip lines 102*a* and 102*b*. Therefore, the opposing area between the switch movable element 111 and the microstrip lines 102*a* and 102*b* becomes (L−G)×W.

In contrast to this, in the micromachine switch 1 shown in FIG. 1, the width a of the switch movable element 11 is smaller than the width W of each of the microstrip lines 2*a* and 2*b*. The width of the opposing portion between the switch movable element 11 and microstrip lines 2*a* and 2*b* is thus made small, and the opposite area becomes (L−G)×a.

In this manner, since the switch movable element 11 is formed to have the width a smaller than the width W of each of the microstrip lines 2*a* and 2*b*, thereby decreasing the opposing area and the capacitance formed between the switch movable element 11 and microstrip lines 2*a* and 2*b*. Since this weakens the coupling between the microstrip lines 2*a* and 2*b*, energy leakage can be suppressed in the OFF state of the micromachine switch 1.

Figure 13:
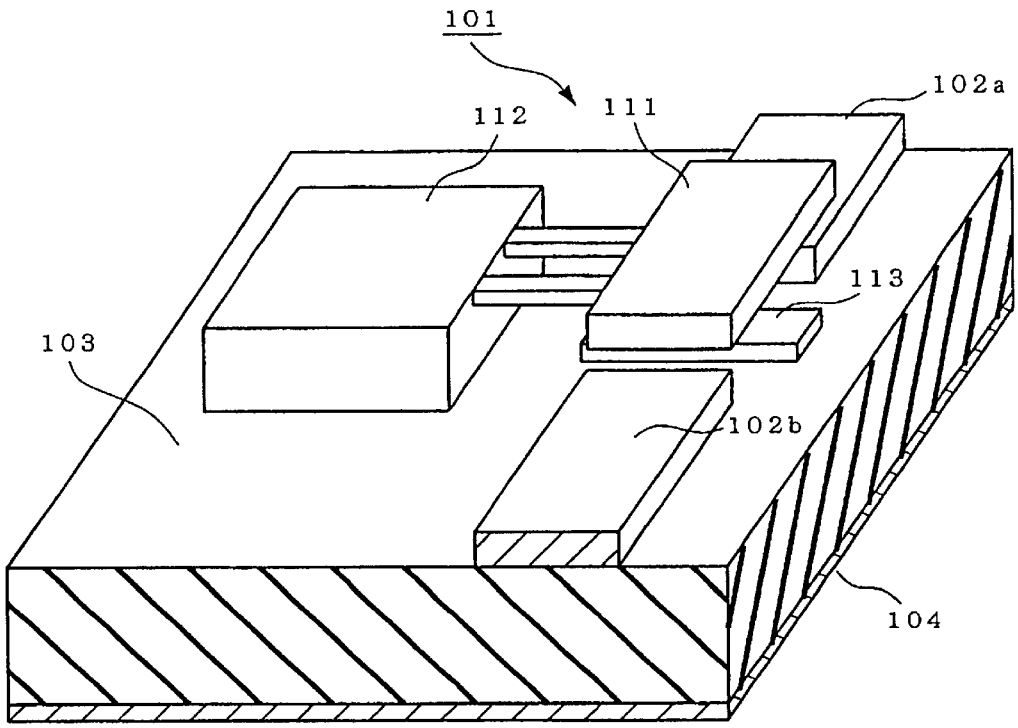
FIG. 13 Prior Art
FIG. 13 is a perspective view showing the structure of the conventional switch movable element.
Figure 14:
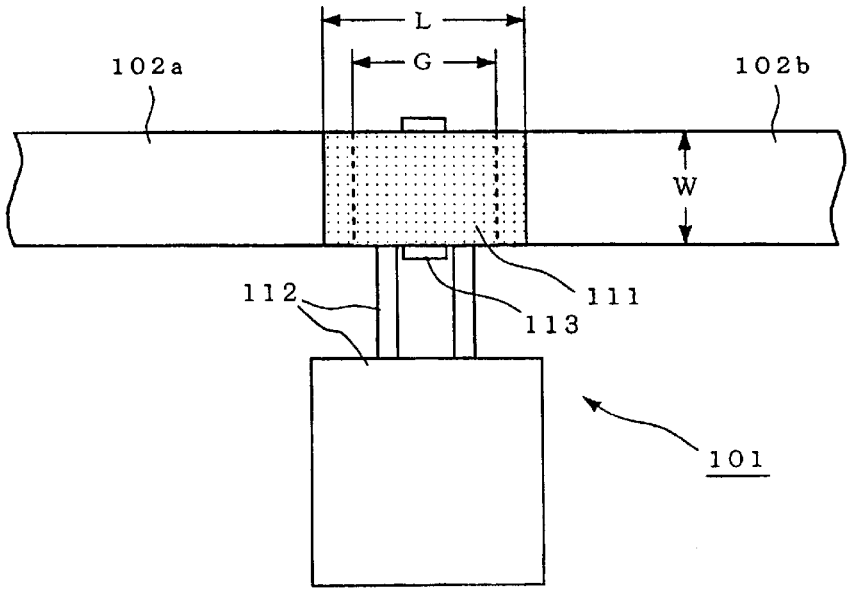
FIG. 14 Prior Art
FIG. 14 is a plan view of the micromachine switch shown in FIG. 13.

The OFF isolation characteristics of the micromachine switch 1 according to the present invention shown in FIG. 1 and the conventional micromachine switch 101 shown in FIG. 13 will be described here.

Table 1 shows the calculation results of OFF isolation characteristics, which are obtained when predetermined parameters are set. More specifically, the thickness of each of the dielectric substrates 3 and 103 is H=200 μm; relative dielectric constant of each of the dielectric substrates 3 and 103, ∈r=4.6; the width, W=370 μm; the gap, G=200 μm; the height of each of the switch movable elements 11 and 111, h=5 μm; the length of each of the switch movable elements 11 and 111, L=260 μm; and a frequency of a high-frequency energy, 30 GHz. The width a of each of the switch movable elements 11 and 111 is shown in Table 1.

TABLE 1

| Switch Movable Element | Parameter | Isolation Characteristic |
|---|---|---|
| 111 | a = 370 μm | 12 dB |
| 11 | a = 300 μm | 13 dB |
| | a = 200 μm | 15 dB |
| | a = 100 μm | 18 dB |

Assuming that letting Ein be an input energy from the microstrip line 2*a* or 102*a* to the switch movable element 11 or 111, and Eout be an output energy output from the switch movable element 11 or 111 to the microstrip line 2*a* or 102*a*. In this case, the isolation characteristic is obtained by equation ①.

$$\text{(Isolation characteristic)} = -10 \log(\text{Eout}/\text{Ein}) \quad ①$$

As is obvious from equation ①, an increase in isolation characteristic value can implement a high degree of isolation. As shown in Table 1, a decrease in width a of each of the switch movable elements 11 and 25 111 increases the isolation characteristic value. Therefore, an OFF isolation characteristic can be improved by using the micromachine switch 1 of the present invention as shown in FIG. 1.

The micromachine switch 1 shown in FIG. 1 is used for a microwave switching circuit, phase shifter, variable filter, or the like. For example, a microwave switching circuit requires an isolation of approximately 15 dB or more. If, therefore, the micromachine switch 1 shown in FIG. 1 is applied to the microwave switching circuit, the width a of the switch movable element 11 is set to 200 μm or less, thereby obtaining a good switching characteristic.

Note that, the required isolation changes depending on microwave or milliwave circuits to which the micromachine switch 1 is applied. Even if, therefore, the width a of the switch movable element 11 is 200 μm or more, the effect is obtained in some cases.

On the other hand, assume that a positive voltage is applied to the switch electrode 13 as a control voltage. In this case, positive charges appear on the surface of the switch electrode 13. Also, negative charges appear on the surface of the switch movable element 11 opposing the switch electrode 13 by electrostatic induction. An attraction force is generated by the electrostatic force between the positive charges of the switch electrode 13 and the negative charges of the switch movable element 11.

As shown in FIG. 3(*b*), this attraction force pulls down the switch movable element 11 toward the switch electrode 13. When the switch movable element 11 is brought into contact with the microstrip lines 2*a* and 2*b*, the micromachine switch 1 is turned on. At this time, the high-frequency energy is transmitted from the microstrip line 2*a* to the microstrip line 2*b* through the switch movable element 11.

Second Embodiment

Figure 4:
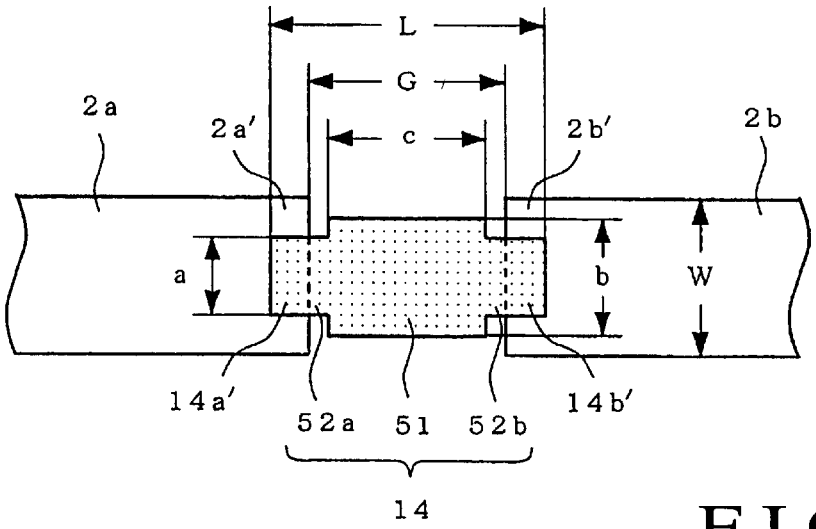
FIG. 4 is a plan view showing the main part of a micromachine switch according to the second embodiment of the present invention.

FIG. 4 is a plan view showing the major part of a micromachine switch according to the second embodiment of the present invention. In FIG. 4, the same reference numerals as in FIG. 2 denote the same parts, and a detailed description thereof will be omitted. A switch movable element 14 shown in FIG. 4 is cantilevered on a support means 12, similar to the switch movable element 11 shown in FIG. 2. A switch electrode 13 is disposed at a gap G between microstrip lines 2*a* and 2*b*. In FIG. 4, however, the description of the support means 12 and switch electrode 13 is omitted.

This also applies to FIGS. 5 to 9 (to be described later).

A micromachine switch 1 shown in FIG. 4 uses the switch movable element 14 shown in FIG. 4 in place of the switch movable element 11 shown in FIG. 1.

The two ends of an edge of the switch movable element 14 on the microstrip line 2*a* side are notched to form a projection (second projection) 52*a*. Similarly, the two ends of the edge of the switch movable element 14 on the microstrip line 2*b* side are notched to form a projection (second projection) 52*b*.

In this case, a portion of the switch movable element 14 except the projections 52*a* and 52*b* is defined as a movable element main body 51. More specifically, the movable element main body 51 is a portion of the switch movable element 14 having a width b. Similarly, a portion of a switch movable element 15 except for projections 54*a* and 54*b* is defined as a movable element main body 53. More specifically, the movable element main body 53 is a portion of the switch movable element 15 having a width b.

Each of the projections 52*a* and 52*b* has a rectangular shape. A width a of each of the projections 52*a* and 52*b* is smaller than the width W of each of the microstrip lines 2*a* and 2*b*.

Since a length c of the movable element main body 51 is a smaller than the gap G between the microstrip lines 2*a* and 2*b*, the movable element main body 51 is not included in distal end portions 14*a*' and 14*b*' of the switch movable element 14. That is, the movable element main body 51 does not oppose the microstrip lines 2*a* and 2*b*.

Similar to the micromachine switch 1 shown in FIG. 1, the opposing area between the switch movable element 14 and the microstrip lines 2*a* and 2*b* thus becomes (L−G)×a. That is, the isolation characteristic equal to that obtained by the micromachine switch 1 shown in FIG. 1 can be obtained by the micromachine switch 1 shown in FIG. 4.

Since the impedance of a line is related to the surface area of the line, a decrease in width of the line increases the impedance. For this reason, if the width of the whole switch movable element 11 decreases, like the micromachine switch 1 shown in FIG. 1, the characteristic impedance on the gap G increases in the ON state of the micromachine switch 1.

High-frequency energy reflection occurs at a discontinuous portion in the line. An increase in characteristic impedance on the gap G results in impedance mismatching. Thus, the reflection increases in the ON state of the micromachine switch 1.

In contrast to this, in the switch movable element 14 shown in FIG. 4, the width b of the movable element main body 51 is larger than the width a of each of the projections 52*a* and 52*b* respectively opposing the microstrip lines 2*a* and 2*b*. More specifically, the width b of the movable element main body 51 is closer to the width W of each of the microstrip lines 2*a* and 2*b* than the width a of each of the projections 52*a* and 52*b*. Accordingly, the impedance mismatching in the switch movable element 14 is reduced, thereby suppressing the reflection of the high-frequency energy in the ON state.

The OFF isolation characteristics and ON reflection characteristics of the micromachine switches 1 shown in FIGS. 1 and 4 will be described.

Table 2 shows the calculation results of OFF isolation characteristics and ON reflection characteristics, which are obtained when predetermined parameters are set. Parameters except for a, b, and c are the same as those shown in Table 1.

TABLE 2

| Switch Movable Element | Parameter | Isolation Characteristic | Reflection Characteristic |
|---|---|---|---|
| 11 | a = 200 μm | 15 dB | −23 dB |
| | a = 150 μm | 17 dB | −20 dB |
| | a = 100 μm | 18 dB | −17 dB |
| 14 | a = 100 μm | 18 dB | −21 dB |
| | b = 200 μm | | |
| | c = 180 μm | | |

Letting Ein be the input energy input from the microstrip line 2*a* or 102*a* to the switch movable element 11 or 14, and Ere be the reflection energy from switch movable element 11 or 14 to the microstrip line 2*a* or 102*a*, the reflection characteristic is obtained by equation ②.

$$(\text{Reflection characteristic})=10\log(\text{Ere}/\text{Ein}) \quad ②$$

As is obvious in equation ②, a decrease in reflection characteristic value reduces the energy loss.

In Table 2, the switch movable element 14 is compared with the switch movable element 11 when a=100 μm. The isolation characteristic values of the elements 14 and 11 are equal as 18 dB. However, the value of the reflection characteristic of the switch movable element 14 is smaller than that of the switch movable element 11. In this manner, the energy loss can be improved in the ON state by using the switch movable element 14 shown in FIG. 4.

Note that, the sizes L, a, b, and c of the switch movable element 14 are set based on the sizes W and G of the microstrip lines 2*a* and 2*b*, thereby selecting appropriate isolation and reflection characteristics.

Figure 5:
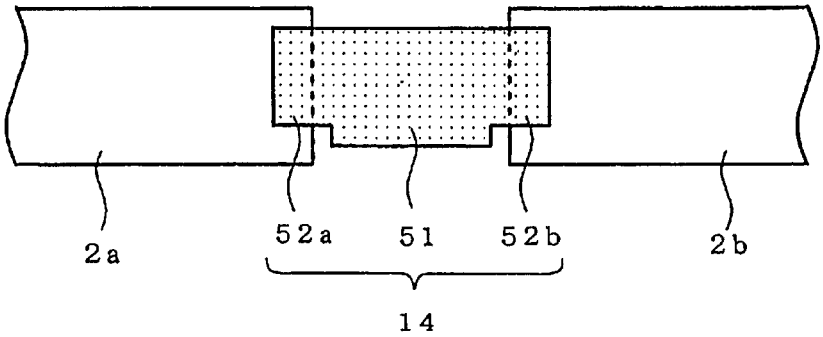
FIG. 5 is a plan view showing another shape of the switch movable element shown in FIG. 4.
Figure 6:
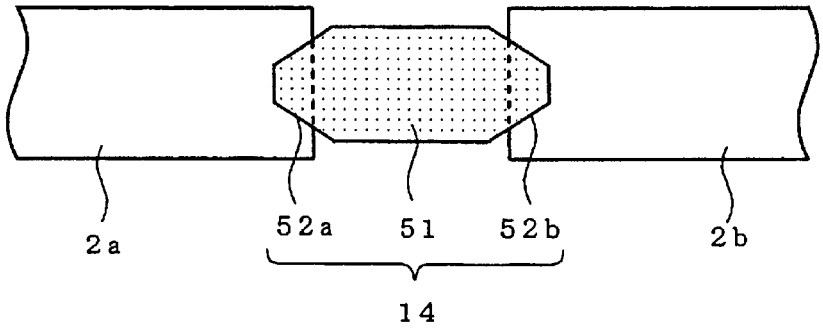
FIG. 6 is a plan view showing still another shape of the switch movable element shown in FIG. 4.

FIGS. 5 and 6 are plan views each showing another shape of the switch movable element 14 shown in FIG. 4.

As shown in FIG. 5, the switch movable element 14 may be obtained by notching one end of an edge of the switch movable element 14 on each of the microstrip lines 2*a* and 2*b*. In the switch movable element 14 shown in FIG. 5, the opposing area between the switch movable element 14 and the microstrip lines 2*a* and 2*b* increases as compared to that of the switch movable element 14 shown in FIG. 4. However, an OFF isolation characteristic better than that of the conventional micromachine switch 1 shown in FIG. 13 can be obtained.

In addition, the shape of each of the projections 52*a* and 52*b* of the switch movable element 14 is not limited to the rectangular shape. For example, as shown in FIG. 6, each of the projections (second projections) 52*a* and 52*b* may have a trapezoidal shape. The width of each of the projections 51*a* and 52*b* near the movable element main body 51 is made larger than that away from the movable element main body 51. This can increase the strength of the switch movable element 14.

Note that, the width b of the movable element main body 51 of the switch movable element 14 shown in FIGS. 4 to 6 is smaller than the W of each of the microstrip lines 2*a* and 2*b*. However, the width b of the movable element main body 51 may be made large within the range in which no reflection characteristic greatly degrades.

Third Embodiment

Figure 7:
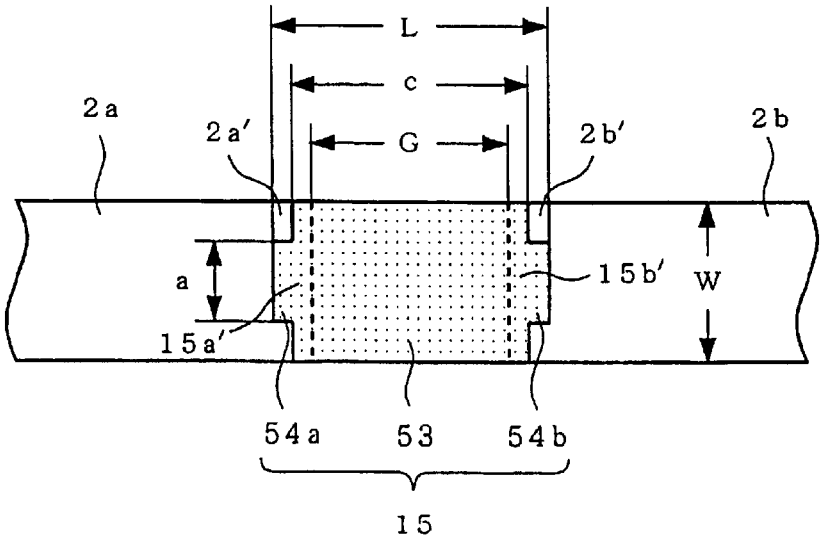
FIG. 7 is a plan view showing the main part of micromachine switch according to the third embodiment of the present invention.

FIG. 7 is a plan view showing the main part of a micromachine switch according to the third embodiment of the present invention. A switch movable element 15 shown in FIG. 7 is different from the switch movable element 14 in FIG. 4 in that a length c of a movable element main body 53 is larger than a gap G, and a width b of the movable element main body 53 is equal to a width W of each of microstrip lines 2*a* and 2*b*. In FIG. 7, reference numerals 54*a* and 54*b* denote projections (second projections).

Since the length c of the movable element main body 53 is larger than the gap G, the portions of the movable element main body 53 are included in distal end portions 15*a*' and 15*b*' of the switch movable element 15. That is, the portions of the movable element main body 53 oppose the microstrip lines 2*a* and 2*b*, respectively.

Thus, the opposing area between the switch movable element 15 in FIG. 7 and microstrip lines 2*a* and 2*b* becomes larger than that shown in FIG. 4. By using the switch movable element 15 in FIG. 7, therefore, an OFF isolation characteristic becomes worse than that by using the switch movable element 11 or 14 in FIG. 1 or 4. Even if so, the isolation characteristic better than that in the prior art can be obtained.

Since, however, the length c of the movable element main body 53 is larger than the gap G, the notched portions of the switch movable element 15 are not present on the gap G. In addition, the width b of the movable element main body 53 is equal to the width W of each of the microstrip lines 2*a* and 2*b*.

With this arrangement, the discontinuous portion of the micromachine switch 1 in the ON state shown in FIG. 7 is only a portion where the switch movable element 15 is in contact with the microstrip lines 2*a* and 2*b*. By using the switch movable element 15 in FIG. 7, therefore, an ON reflection characteristic can be improved better than that in the switch movable element shown in FIG. 4.

The width b of the movable element main body 53 is equal to the width W of each of the microstrip lines 2*a* and 2*b*. The effect can be obtained even if the width b is completely equal to the width W.

The switch movable element 15 may be obtained by notching one end of an edge of the switch movable element 15 on each of the microstrip lines 2*a* and 2*b*.

In addition, each of projections 54*a* and 54*b* of the switch movable element 15 is not limited to have the rectangular shape and, for example, may have a trapezoidal shape.

Fourth Embodiment

Figure 8:
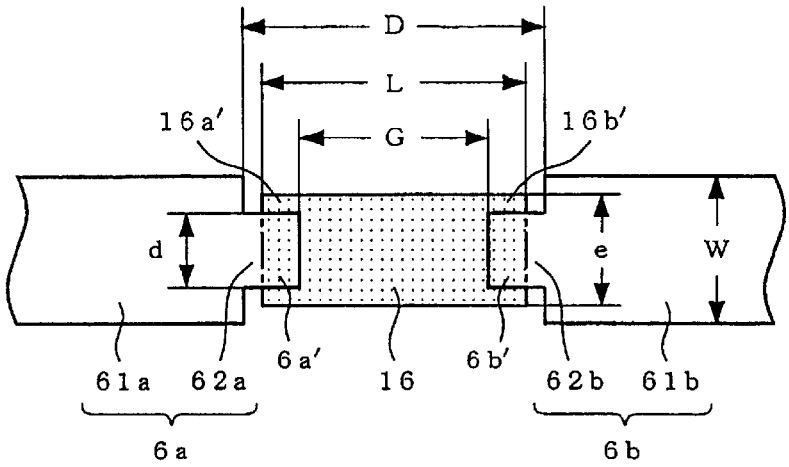
FIG. 8 is a plan view showing the main part of micromachine switch according to the fourth embodiment of the present invention.

FIG. 8 is a plan view showing the main part of a micromachine switch according to the fourth embodiment of the present invention.

As shown in FIG. 8, a switch movable element 16 has a rectangular shape. On the other hand, in a microstrip line 6*a*, the two ends of an edge of the microstrip line 6*a* on the switch movable element 16 side are notched to form a projection (first projection) 62*a*. Similarly, in a microstrip line 6*b*, the two ends of the edge of the microstrip line 6*b* on the switch movable element 16 side are notched to form a projection (first projection) 62*b*.

In this case, portions of the microstrip lines 6*a* and 6*b* except for the projections 62*a* and 62*b* are defined as line main bodies 61*a* and 62*b*, respectively. More specifically, the line main bodies 61*a* and 61*b* are portions of the microstrip lines 6*a* and 6*b* each having a width W. Similarly, portions of microstrip lines 7*a* and 7*b* except for projections 72*a* and 72*b* are defined as line main bodies 71*a* and 71*b*, respectively. More specifically, the line main bodies 71*a* and 71*b* are portions of the microstrip lines 7*a* and 7*b* each having the width W.

Each of the projections 62*a* and 62*b* has a rectangular shape. A width d of each of the projections 62*a* and 62*b* is smaller than a width e of the switch movable element 16.

A distance D between the line main bodies 61*a* and 61*b* of the microstrip lines 6*a* and 6*b* is larger than a length L of the switch movable element 16. With this structure, the line main bodies 61*a* and 61*b* are not included in distal end portions 6*a*' and 6*b*' of the microstrip lines 6*a* and 6*b*, respectively. That is, the line main bodies 61*a* and 61*b* do not oppose the switch movable element 16.

In this manner, in a micromachine switch 1 shown in FIG. 8, the projections 62*a* and 62*b* are formed in the microstrip lines 6*a* and 6*b*, respectively, in place of forming the projections 52*a* and 52*b* in the switch movable element 14 in the micromachine switch 1 shown in FIG. 4. Other parts in this embodiment are the same as those in the micromachine switch 1 shown in FIG. 4.

Therefore, for example, each of the projections 62*a* and 62*b* of the microstrip lines 6*a* and 6*b* can be formed by notching one end of an edge of a corresponding one of the microstrip lines 6*a* and 6*b* on the switch movable element 16 side. In addition, each of projections 54*a* and 54*b* is not limited to have the rectangular shape and, for example, may have a trapezoidal shape.

Even if the micromachine switch 1 is formed in such a manner, the effect similar to that of the micromachine switch 1 shown in FIG. 4 can be obtained.

Fifth Embodiment

Figure 9:
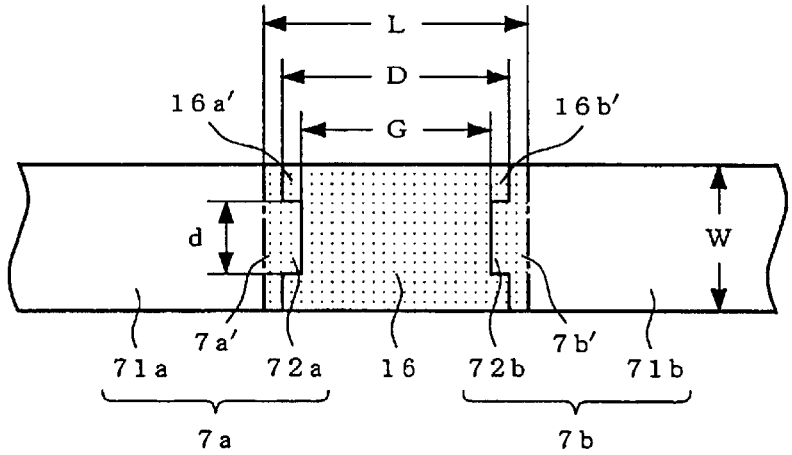
FIG. 9 is a plan view showing the main part of a micromachine switch according to the fifth embodiment of the present invention.

FIG. 9 is a plan view showing the main part of a micromachine switch according to the fifth embodiment of the present invention. The micromachine switch shown in FIG. 9 is different from the micromachine switch 1 shown in FIG. 8 in the following points.

First, a distance D between line main bodies 71*a* and 71*b* of microstrip lines 7*a* and 7*b* is smaller than a length L of a switch movable element 16. With this structure, the line main bodies 71*a* and 71*b* are included in distal end portions 7*a*' and 7*b*' of the microstrip lines 7*a* and 7*b*, respectively. That is, the line main bodies 71*a* and 71*b* oppose the switch movable element 16.

In addition, a width e of the switch movable element 16 is equal to a width W of each of the microstrip lines 7*a* and 7*b*. Other parts in this embodiment are the same as those in the micromachine switch 1 shown in FIG. 8. In FIG. 9, reference numerals 72*a* and 72*b* denote projections (first projections).

Even if a micromachine switch 1 is disposed in such a manner, the effect similar to that of the micromachine switch 1 shown in FIG. 7 can be obtained.

Note that, the width e of the switch movable element 16 is equal to the width W of each of the microstrip lines 7*a* and 7*b*. The effect can be obtained even if the width e is not completely equal to the width W.

Sixth Embodiment

Figure 10:
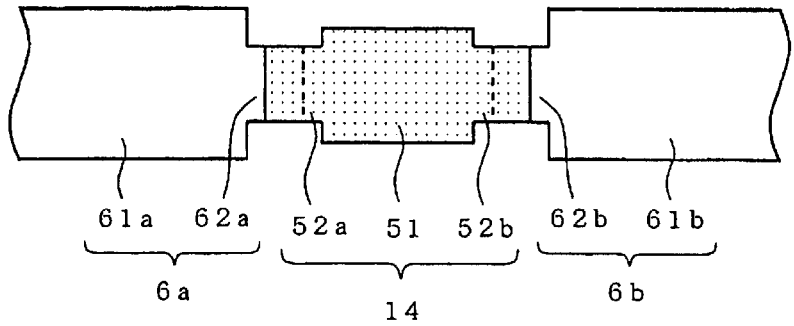
FIG. 10 is a plan view showing the main part of a micromachine switch according to the sixth embodiment of the present invention.

FIG. 10 is a plan view showing the main part of a micromachine switch according to the sixth embodiment of the present invention. The micromachine switch shown in FIG. 10 is formed by combining the switch movable element 14 shown in FIG. 4 with the microstrip lines 6*a* and 6*b* shown in FIG. 8.

In this manner, even if both switch movable element 14 and microstrip lines 6*a* and 6*b* are notched, the opposing area between the switch movable element 14 and microstrip lines 6*a* and 6*b* can be decreased, thereby improving the OFF isolation characteristic of a micromachine switch 1.

Note that, a width a of each of the projections 52*a* and 52*b* of the switch movable element 14 may be equal to or different from a width d of each of projections 62*a* and 62*b* of the microstrip lines 6*a* and 6*b*.

In addition, each of the switch movable elements 14 and 15 shown in FIGS. 5 to 7 may be used in place of the switch movable element 14 shown in FIG. 4, and the microstrip lines 7*a* and 7*b* shown in FIG. 9 may be used in place of the microstrip lines 6*a* and 6*b* shown in FIG. 8.

As described above, the embodiments of the present invention have been described by using the micromachine switch 1 having the arrangement in which a switch electrode 13 is disposed on a gap G. The present invention is, however, applied to a micromachine switch 8 having the sectional shape shown in FIG. 11.

Figure 11:
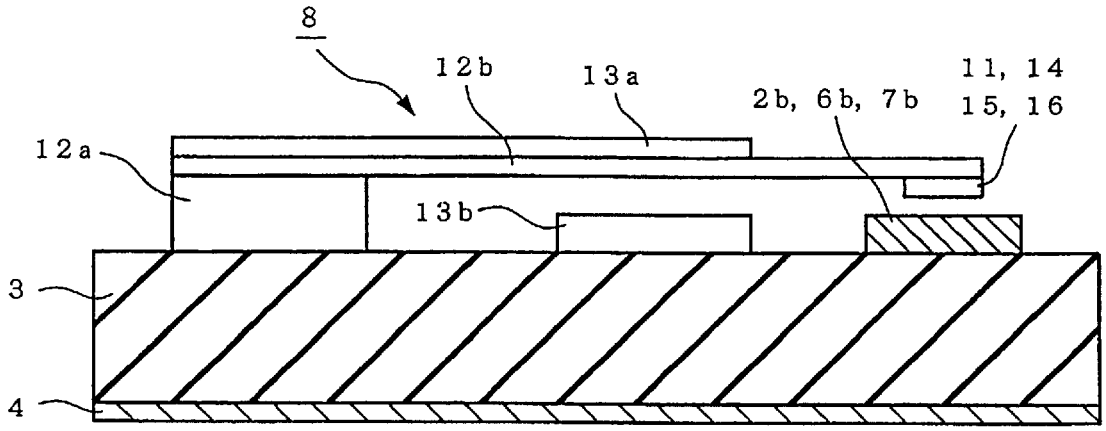
FIG. 11 is a sectional view showing the section of a micromachine switch having another arrangement.

That is, the micromachine switch 8 shown in FIG. 11 has an upper electrode 13*a* and lower electrode 13*b* as switch electrodes (driving means). The lower electrode 13*b* is formed on a dielectric substrate 3, below an arm portion 12*b* of a support means, and is not sandwiched between microstrip lines 2*a* and 2*b* (or 6*a* and 6*b* or 7*a* and 7*b*). The upper electrode 13*a* is tightly formed on the upper surface of the arm portion 12*b*. The upper and lower electrodes 13*a* and 13*b* sandwich the arm portion 12*b* therebetween and oppose each other. The arm portion 12*b* is made of an insulating member.

A driving voltage is selectively applied to at least one of the upper and lower electrodes 13*a* and 13*b*. The arm portion 12*b* is pulled down by an electrostatic force, and a switch movable element 11 (or 14, 15, or 16) is brought into contact with the microstrip lines 2*a* and 2*b* (or 6*a* and 6*b* or 7*a* and 7*b*).

Even if the present invention is applied to this micromachine switch 8, the effect described above can be obtained.

In any one of the switch movable elements 14 and 15 in the FIGS. 4 to 7, the two sides of the switch movable element 14 or 15 are notched to form projections 52*a* and

52*b* or 54*a* and 54*b*. However, even if the projection 52*a* or 52*b* is formed on only one side of the switch movable element 14, or even if the projection 54*a* or 54*b* is formed on only one side of the switch movable element 15, the effect can be obtained.

This also applies to the microstrip lines 6*a* and 6*b* and 7*a* and 7*b* in FIGS. 8 and 9. More specifically, even if the projection 62*a* or 62*b* is formed in only one of the microstrip lines 6*a* and 6*b*, or even if the projection 72*a* or 72*b* is formed in only one of the microstrip lines 7*a* and 7*b*, the effect can be obtained.

In addition, each of the micromachine switches 1 and 8 shown in FIGS. 1 to 11 connects/disconnects two microstrip lines 2*a* and 2*b* (or 6*a* and 6*b* or 7*a* and 7*b*) to/from each other. However, the present invention is also applied to each of the micromachine switch 1 and 8 connecting/disconnecting three or more microstrip lines to/from each other.

In describing the embodiments of the present invention, the microstrip lines 2*a* and 2*b* (or 6*a* and 6*b* or 7*a* and 7*b*) are used as distributed constant lines. Even if, however, coplanar lines, triplet lines, or slot lines are used as the distributed constant lines, the same effect can be obtained.

The micromachine switch 1 or 8 shown in FIGS. 1 to 11 may be an ohmic connection type micromachine switch or capacitive connection type micromachine switch.

Figure 12A:
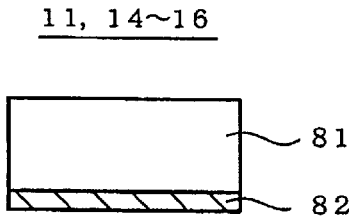
FIGS. 12A and 12B show sectional views of the sections of the switch movable elements.
Figure 12B:
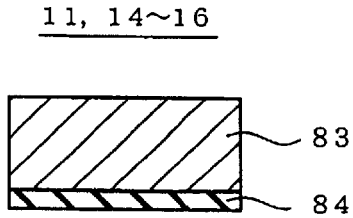

In an ohmic connection type micromachine switch 1 or 8, the whole switch movable elements 11 and 14 to 16 may be made of conductive members. As shown in FIG. 12(*a*), each of the switch movable elements 11 and 14 to 16 may be constructed by a member 81 of a semiconductor or insulator, and a conductive film 82 formed on the entire lower surface of the member 81 (i.e., the surface opposite to the microstrip lines 2*a* and 2*b* or the like). That is, in the switch movable elements 11 and 14 to 16, at least the entire lower surface of each of the switch movable elements 11 and 14 to 16 may be made of a conductor.

In addition, as shown in FIG. 12(*b*), a capacitive connection type micromachine switch 1 or 8 is constructed by a conductive member 83 and insulating thin film 84 formed on the lower surface of the conductive member 83 (i.e., the surface opposing the microstrip lines 2*a* and 2*b* or the like).

Industrial Applicability

A micromachine switch according to the present invention is suitable for a switch device for high-frequency circuits such as a phase shifter and frequency variable filter used in a milliwave band to microwave band.

What is claimed is:

1. A micromachine switch characterized by comprising:

at least two distributed constant lines disposed close to each other;

a movable element arranged above said distributed constant lines so as to oppose said distributed constant lines and connecting said distributed constant lines to each other in a high-frequency manner upon contacting said distributed constant lines; and driving means for displacing said movable element by an electrostatic force to bring said movable element into contact with said distributed constant lines, wherein said movable element includes a projection formed by notching at least one end of an edge of said movable element which is located on at least one distributed constant line side, and a width of the projection serving as a length in a direction parallel to the widthwise direction of said distributed constant lines is smaller than that of each of said distributed constant lines.

2. A micromachine switch according to claim 1, characterized in that said at least one distributed constant line opposing the projection of said movable element does not oppose a movable element main-body serving as a portion of said movable element except for the projection.

3. A micromachine switch according to claim 1, characterized in that at least an entire lower surface of said movable element is made of a conductor.

4. A micromachine switch according to claim 1, characterized in that said movable element is made of a conductive member, and an insulating thin film formed on an entire lower surface of the conductive member.

5. A micromachine switch according to claim 1, characterized in that the projection of said movable element has a rectangular shape.

6. A micromachine switch according to claim 1, characterized in that a width of the projection of said movable element near the movable element main body serving as a portion of said movable element except for the projection is made larger than that away from the movable element main body.

7. A micromachine switch according to claim 1, characterized in that said driving means comprises an electrode which is disposed apart between said distributed constant lines so as to opposite to said movable element and to which a driving voltage is selectively applied.

8. A micromachine switch according to claim 1, characterized in that said switch further comprises support means for supporting said movable element, said driving means is made of an upper electrode attached to said support means, and a lower electrode disposed under the upper electrode and opposing the upper electrode, and a driving voltage is selectively applied to at least one of the upper and lower electrodes.

9. A micromachine switch according to claim 1, characterized in that said at least one distributed constant line opposing the projection of said movable element also opposes a part of a movable element main body serving as a portion of said movable element except for the projection.

10. A micromachine switch according to claim 9, characterized in that a width of the movable element main body of said movable element is equal to the width of each of said distributed constant lines.

11. A micromachine switch characterized by comprising:

at least two distributed constant lines disposed close to each other;

a movable element arranged above said distributed constant lines so as to oppose said distributed constant lines and connecting said distributed constant lines to each other in a high-frequency manner upon contacting said distributed constant lines; and driving means for displacing said movable element by an electrostatic force to bring said movable element into contact with said distributed constant lines, wherein at least one distributed constant line includes a projection formed by notching at least one end of an edge of said at least one distributed constant line on the movable element side, and a width of the projection is smaller than a length, serving as a width of said movable element, in a direction parallel to the widthwise direction of said distributed constant lines.

12. A micromachine switch according to claim 11, characterized in that said movable element does not oppose a distributed constant line main body serving as a portion, except for the projection, of said at least one distributed constant line having the projection.

13. A micromachine switch according to claim 11, characterized in that the projection of said at least one distributed constant line has a rectangular shape.

14. A micromachine switch according to claim 11, characterized in that at least an entire lower surface of said movable element is made of a conductor.

15. A micromachine switch according to claim 11, characterized in that said driving means comprises an electrode which is disposed apart between said distributed constant lines so as to opposite to said movable element and to which a driving voltage is selectively applied.

16. A micromachine switch according to claim 11, characterized in that said movable element is made of a conductive member, and an insulating thin film formed on an entire lower surface of the conductive member.

17. A micromachine switch according to claim 11, characterized in that said switch further comprises support means for supporting said movable element, said driving means is made of an upper electrode attached to said support means, and a lower electrode disposed under the upper electrode and opposing the upper electrode, and a driving voltage is selectively applied to at least one of the upper and lower electrodes.

18. A micromachine switch according to claim 11, characterized in that said movable element also opposes a part of a distributed constant line main body serving as a portion, except for the projection, of said at least one distributed constant line having the projection.

19. A micromachine switch according to claim 18, characterized in that a width of the movable element is equal to the width of each of the distributed constant line main bodies of said distributed constant lines.

20. A micromachine switch characterized by comprising:

at least two distributed constant lines disposed close to each other;

a movable element arranged above said distributed constant lines so as to oppose said distributed constant lines and connecting said distributed constant lines to each other in a high-frequency manner upon contacting said distributed constant lines; and driving means for displacing said movable element by an electrostatic force to bring said movable element into contact with said distributed constant lines, wherein at least one distributed constant line includes a first projection formed by notching at least one end of an edge of said at least one distributed constant line on the movable element side, and said movable element has a second projection so formed as to oppose the first projection of said at least one distributed constant line by notching at least one end of an edge of said movable element.

* * * * *

UNITED STATES PATENT AND TRADEMARK OFFICE

CERTIFICATE OF CORRECTION

PATENT NO. : 6,433,657 B1
DATED : August 13, 2002
INVENTOR(S) : Shuguang Chen

It is certified that error appears in the above-identified patent and that said Letters Patent is hereby corrected as shown below:

Column 6,
Line 27, delete "16b" insert -- 16b' --

Column 7,
Line 49, after "and" delete "25"

Column 8,
Line 39, after "52b" insert -- That is, the switch movable element 14 has the projections 52a and 52b so formed as to oppose the microstrip lines 2a and 2b by notching four corners of a rectangle when viewed from the top. --

Column 11,
Line 14, after "62a" insert -- That is, the microstrip line 6a has the projection 62a so formed as to oppose the switch movable element 16 by notching two corners of a rectangle when viewed from the top. --
Line 17, after "62b" insert -- That is, the microstrip line 6b has the projection 62b so formed as to oppose the switch movable element 16 by notching two corners of a rectangle when viewed from the top.

Column 13,
Lines 19-23, delete "In describing the embodiments of the present invention, the microstrip lines 2a and 2b (or 6a and 6b or 7a and 7b) are used as distributed constant lines. Even if, however, coplanar lines, triplet lines, or slot lines are used as the distributed constant lines, the same effect can be obtained."

Column 13, lines 51-67 through Column 14, lines 1-2,
Lines 1-19, delete "A micromachine switch...distributed constant lines." insert -- A micromachine switch characterized by comprising: at least two microstrip lines disposed close to each other; a moveable element arranged above said microstrip lines so as to oppose to said microstrip lines and connecting said microstrip lines to each other in a high-frequency manner upon contacting said microstrip lines; and driving means for displacing said movable element by an electrostatic force to bring said movable element into contact with said microstrip lines, where in said movable element includes a projection so formed as to oppose said microstrip lines by notching a least one corner of a rectangle when viewed from the top, and a width of the projection serving as a length in the direction parallel to a horizontal direction of said microstrip lines is narrower than that of each of said microstrip lines. --

Column 14,
Lines 5, 34 and 51, delete "distributed constant line" insert -- microstrip line --
Line 59, delete "distributed constant lines" insert -- microstrip line --

UNITED STATES PATENT AND TRADEMARK OFFICE

CERTIFICATE OF CORRECTION

PATENT NO. : 6,433,657 B1
DATED : August 13, 2002
INVENTOR(S) : Shuguang Chen

It is certified that error appears in the above-identified patent and that said Letters Patent is hereby corrected as shown below:

Columns 14, lines 61, 63-64, 64-65, 65 and 67 and Column 15, ine 3,
Delete all instances "distributed constant lines" insert -- microstrip lines --

Column 15,
Lines 4-11, delete ..."where in at least ...said distributed constant lines." insert -- wherein said at least one microstrip line includes a projection so formed as to oppose said moveable element by notching at least a corner of a rectangle when viewed from the top, and a width of the projection of said at least one microstrip line is narrower than a length, serving as a width of said movable element, in the direction parallel to a horizontal direction of said microstrip lines. --
Lines 14 and 15, 16 and 17, 21 and 30, delete "distributed constant line" insert -- microstrip line --

Column 16,
Lines 11 and 12, 13 and 14, 18 and 19, delete "distributed constant line" insert -- microstrip line --.
Lines 21, 23-24, 24-25, 25, 27 and 30, delete all instances of "distributed constant lines" insert -- microstrip lines --
Lines 31-38, delete... "wherein at least one ...said movable element." insert -- wherein at least one microstrip line has a first projection on the movable element side formed by notching at least one corner of a rectangle when viewed from the top, and said movable element has a second projection so formed as to oppose the first projection by notching one corner of a rectangle when viewed from the top. --

Signed and Sealed this

Third Day of February, 2004

JON W. DUDAS
*Acting Director of the United States Patent and Trademark Office*